US007818941B2

(12) United States Patent
Freudenberg et al.

(10) Patent No.: US 7,818,941 B2
(45) Date of Patent: Oct. 26, 2010

(54) PLASTIC SHEET BARRIER ENCLOSURE, SYSTEM, AND METHOD

(75) Inventors: Christopher F. Freudenberg, Forest Lake, MN (US); William J. Freudenberg, Isanti, MN (US); David E. LeVasseur, White Bear Lake, MN (US); Eugene L. Baratto, Somerset, WI (US); Curtis L. Larson, Hudson, WI (US); John A. Harrison, Hudson, WI (US)

(73) Assignee: Bearacade Products LLC, Forest Lake, MN (US)

( * ) Notice: Subject to any disclaimer, the term of this patent is extended or adjusted under 35 U.S.C. 154(b) by 607 days.

(21) Appl. No.: 10/722,041

(22) Filed: Nov. 24, 2003

(65) Prior Publication Data

US 2005/0109470 A1 May 26, 2005

(51) Int. Cl.
*E04B 1/00* (2006.01)

(52) U.S. Cl. ..... 52/741.3; 160/405

(58) Field of Classification Search ..... 160/351, 160/135, 368.1, 405; 135/107, 111, 113; 52/741.3, 900, DIG. 12, DIG. 14; 588/249, 588/254, 261

See application file for complete search history.

(56) References Cited

U.S. PATENT DOCUMENTS

| | | | | | |
|---|---|---|---|---|---|
| 2,885,743 | A | * | 5/1959 | Macormack | 52/405.4 |
| 3,002,236 | A | * | 10/1961 | Humphner | 52/202 |
| 3,095,088 | A | * | 6/1963 | Blaikie et al. | 206/440 |
| 3,338,001 | A | * | 8/1967 | Fraser | 52/2.21 |
| 3,349,574 | A | * | 10/1967 | Glasser | 62/239 |
| 3,385,743 | A | * | 5/1968 | Backberg | 428/191 |
| 3,413,775 | A | * | 12/1968 | Katz | 52/737.4 |
| 3,445,322 | A | * | 5/1969 | Saiia et al. | 428/178 |
| 3,567,353 | A | * | 3/1971 | Eisler | 165/223 |
| 3,578,541 | A | * | 5/1971 | Tariel | 220/560.15 |
| 3,729,889 | A | * | 5/1973 | Baruzzini | 52/264 |
| 4,082,705 | A | | 4/1978 | Beede et al. | |
| 4,207,374 | A | | 6/1980 | Groff | |
| 4,229,329 | A | | 10/1980 | Bennett | |
| 4,248,917 | A | | 2/1981 | Hornibrook et al. | |
| 4,263,347 | A | * | 4/1981 | Banta | 427/282 |
| 4,588,627 | A | | 5/1986 | Isaksen et al. | |
| 4,599,265 | A | | 7/1986 | Esmay | |
| 4,604,111 | A | | 8/1986 | Natale | |
| 4,699,842 | A | * | 10/1987 | Jorgensen et al. | 428/343 |
| 4,787,179 | A | * | 11/1988 | Lewis | 451/89 |
| 4,842,919 | A | | 6/1989 | David et al. | |
| 4,857,085 | A | | 8/1989 | Egri, II | |
| 4,883,512 | A | * | 11/1989 | Griffis | 55/356 |
| 4,934,396 | A | * | 6/1990 | Vitta | 135/139 |
| 4,981,544 | A | | 1/1991 | Nordale | |

(Continued)

FOREIGN PATENT DOCUMENTS

| | | |
|---|---|---|
| DE | 1 594 240 | 8/1969 |
| DE | 44 21 420 | 12/1995 |
| EP | 0 109 177 | 5/1984 |
| EP | 0 305 161 | 3/1989 |
| EP | 0 352 901 | 1/1990 |

(Continued)

*Primary Examiner*—David Purol
(74) *Attorney, Agent, or Firm*—Kagan Binder, PLLC

(57) ABSTRACT

A method of forming a safer and more secure containment for the removal or isolation of harmful and/or noxious particulate materials. The containment is formed using adhesive coated plastic sheeting to form an isolated enclosure. The adhesive holds the sheeting under negative pressure and is removable with minimal damage or transfer to wall and floor surfaces.

23 Claims, 1 Drawing Sheet

U.S. PATENT DOCUMENTS

| | | | | | |
|---|---|---|---|---|---|
| 5,062,871 | A | | 11/1991 | Lemon, III | |
| 5,067,504 | A | * | 11/1991 | Coleman, III | 134/172 |
| 5,085,859 | A | | 2/1992 | Halloran et al. | |
| 5,090,972 | A | * | 2/1992 | Eller et al. | 95/10 |
| 5,306,861 | A | | 4/1994 | Amos et al. | |
| 5,558,112 | A | | 9/1996 | Strieter | |
| 5,599,601 | A | | 2/1997 | Polski et al. | |
| 5,851,663 | A | | 12/1998 | Parsons et al. | |
| 5,916,391 | A | | 6/1999 | Riedel et al. | |
| 5,922,402 | A | | 7/1999 | Speeney | |
| 5,924,469 | A | * | 7/1999 | Whittemore | 160/368.1 |
| 6,074,745 | A | | 6/2000 | Speeney | |
| 6,187,424 | B1 | | 2/2001 | Kjellqvist et al. | |
| 6,355,323 | B1 | | 3/2002 | Iwen et al. | |
| 6,383,242 | B1 | | 5/2002 | Rogers et al. | |
| 6,387,993 | B1 | | 5/2002 | Batdorf | |
| 2004/0221940 | A1 | * | 11/2004 | Harte | 160/135 X |

FOREIGN PATENT DOCUMENTS

| | | | | |
|---|---|---|---|---|
| EP | 0 437 632 | | 7/1991 | |
| EP | 0 615 983 | | 9/1994 | |
| EP | 0 494 619 | | 12/1995 | |
| EP | 0 775 736 | | 5/1997 | |
| GB | 2 092 476 | A | 8/1982 | |
| GB | 2 289 680 | | 11/1995 | |
| JP | 53-82887 | | 7/1978 | |
| JP | 61-108547 | | 5/1986 | |
| JP | 61-172736 | | 8/1986 | |
| JP | 62-43336 | | 2/1987 | |
| JP | 62-43337 | | 2/1987 | |
| JP | 4-74000 | | 6/1992 | |
| JP | 5-345882 | | 12/1993 | |
| JP | 6-145442 | | 5/1994 | |
| JP | 06-328643 | | 11/1994 | |
| JP | 7-18224 | | 1/1995 | |
| JP | 7-18226 | | 1/1995 | |
| JP | 7-164594 | | 6/1995 | |
| WO | WO 81/01151 | | 4/1981 | |
| WO | WO 90/01411 | | 2/1990 | |
| WO | WO 94/12987 | | 6/1994 | |
| WO | WO 95/32257 | | 11/1995 | |
| WO | WO 97/05206 | | 2/1997 | |
| WO | 2004/011163 | * | 2/2004 | 160/351 X |
| WO | WO 2004/011163 | | 2/2004 | |

* cited by examiner

PLASTIC SHEET BARRIER ENCLOSURE, SYSTEM, AND METHOD

FIELD OF THE INVENTION

The invention relates to methods of isolating a space for containment of materials within the space, such as for the removal of harmful and/or noxious materials. In particular, the invention relates to methods of forming an enclosure to define a contained space using plastic sheeting bearing a removable pressure sensitive adhesive. Such plastic sheeting being for adherence to existing structure, in particular, for the abatement, remediation, or removal of noxious materials.

BACKGROUND

Many types of containment structures and systems have been developed, such as for controlling the interior environment of such an enclosed space. Environmental control may be desirable, for example, during the application or removal of material, coatings, and the like. In some cases, such application or removal methods are conducted to or from existing structures, such as building structures including interior spaces divided into rooms, hallways, stairs, and the like.

In creating a containment space, a volume is enclosed, and depending on characteristics of the materials involved (e.g. gas, liquid, particulate, etc.), the enclosed volume is effectively sealed from an outside environment. That way, the internal environment of the containment space can be controlled. Containment enclosures typically utilize a barrier material to effectively define the interior environment based upon existing structure (e.g. walls, ceiling, floor, doors, etc.), which barrier materials may also cover the various structural elements. That is not to say, however, that the barrier materials are utilized for masking purposes.

Masking of structural elements is typically done for other purposes, such as to prevent damage to or application of something to the covered components. A barrier material may also act as a mask as such structural elements would be covered by the barrier material; however, the goal is still to control the interior space environment. The barrier material actually creates a temporary and removable structure within such an existing structure.

In one current practice of removing harmful materials, such as asbestos, from a building, the surfaces of the room or hallway are covered with a plastic sheet. Any number of sheets can be used to enclose the desired space, which sheets need to be attached to the existing structure to effectively control the environment. The sheets are typically secured by spraying an adhesive as a primer, typically three to four inches wide, along the walls below the ceiling joint, attaching a plastic sheet to the adhesive primed wall using strips of duct tape over the plastic sheet and the adhesive, and finally securing the taped plastic sheet with staples or wooden strips nailed to the wall. The floor is also typically covered with two layers of plastic sheet with each sheet taped to the sides with duct tape.

Environmental control is based not only on creation of such a containment space, such as by the use of barrier materials, but also on the ability to maintain the enclosed space as desired for the relevant period of time. For asbestos removal, the environment must be strictly controlled during the entire abatement process. Any breach of the environment can have potentially negative consequences as particulate material may escape the controlled environment. According to many state codes governing asbestos removal procedures, breaches of such a controlled environment may need to be recorded and maintained.

According to the manner of creating an enclosed environment described above using plastic sheeting, adhesive applied along the sheet edges and taping techniques, one significant possibility for environment breach over time is the falling of one or more sheets from a wall or ceiling. The possibility of such occurring is exasperated because, for asbestos removal, environmental control also includes the maintenance of negative pressure within the enclosed environment. To do this, an exhaust structure is usually defined through a door opening or the like leading to the building space to be abated. An exhaust typically includes a fan sealingly connected to the barrier materials for drawing air from the space and leading to a filter system for removal of any airborne particles or the like. Controlled air into the space can also be provided to create the desired air flow and negative pressure.

However, such air flow and negative pressure can have a deleterious effect on the barrier materials, such a plastic sheeting. The sheeting tends to pull from the walls and billow from the wall, floor and ceiling surfaces away from the edges that are adhered to the walls, ceiling and floor. Billowing tends then to cause a peeling action of the sheeting from the surfaces, which peeling force acts against the cohesive force of the adhesive to the surfaces. Adhesives that are typically used for containment are usually chosen for the best holding power and are not usually chosen to be removable (meaning the sheets can be removed from the surfaces), so that damage often occurs, but the ability to remove is usually based upon the ability to peel the sheeting from the surfaces of the room. As such, a peeling action, such as caused by billowing, can cause a plastic sheet to fall from a wall, ceiling, or floor surface, which can further create a undesirable breach in the environmental control of a containment space.

SUMMARY OF THE INVENTION

The present invention provides an improved method for creating containment spaces based upon the use of a barrier material, such as a plastic film, with improved holding power, preferably provided by better adhesion control, of the material to the structure of the space for effective containment and thus better environmental control of the space. The present invention is particularly advantageous in maintaining such a contained space over a time period even where forces are created, such as a negative pressure, tending to work against the holding power of the barrier materials to the structural surfaces. In particular, it is desirable to create better and more controlled holding power of barrier materials to structural surfaces and to reduce sheet billowing or sheet sagging as such may occur over time and under specific forces like negative pressure.

The present invention also provides a method for containing and/or isolating noxious materials found inside of a structure formed of non-working surfaces and working surfaces (surfaces to be exposed to work on) so that these materials can be safely removed. The method includes forming an enclosure to contain the noxious material by attaching a layer of a flexible barrier sheet (such as plastic film), having a removable holding system, preferably a pressure sensitive adhesive, covering at least one edge zone and an intermediate zone of a first major surface of the sheet, to at least one non-working surface of the structure to form an enclosure around the space from which the materials are to be removed. For example, the enclosure can be bounded on at least one side by an adhesive coated plastic sheet and on at least one other side by a working surface bearing a noxious material. The enclosure may further include other elements, such as, for example, non-working surfaces that are not covered by adhesive coated plastic sheeting and or plastic film(s) that are not adhesive coated. Examples of enclosures include a room having a plurality of walls, a ceiling, and a floor, and at least a part of one of the walls, ceiling, or floor can be covered with the adhesive coated plastic sheet in accordance with one aspect of the present invention; a portion of a hallway with a floor that may be covered with an adhesive coated plastic sheet and the open ends of the hallway can be draped with plastic film that is not adhesive coated; and a plastic sheet having removable pressure sensitive adhesive located adjacent to one or both lateral edges on one or both sides of the plastic sheet, and the adhesive along the edge can be attached to a portion of a ceiling so as to surround a space bounded by the plastic sheet and the ceiling.

As used herein, noxious materials refer to particulate materials that can be hazardous or irritating to mammalian health. Examples of noxious materials that can be removed using this method include, but are not limited to, dust, asbestos, lead, radioactive particles, molds, viruses, and other biohazardous materials. The present invention finds particular applicability to such noxious material removal processes, but also has much greater applicability to any contained situation including where no working surfaces are provided, but where a controlled internal environment is desired, such as for medical, or cleanliness, or other isolation purposes.

As used herein, a structure is a framework around a space, and may include, for example, a building; a room within a building; a hallway; an attic; a pipe chase; a portion of a room; a tunnel; and a space within a boat, motor vehicle, or aircraft; and the like. The framework can include any number of structural elements, and in some cases includes non-working surfaces that are to be isolated while noxious materials or working surfaces are removed. Surfaces, either working or non-working, may include the surfaces of a floor, a wall, a ceiling, fixtures (as may be provided on any floor, ceiling or wall surface) or any combination thereof. Working surfaces are meant to include, but are not limited to, contaminated surfaces that contain noxious materials within them or on them, and surfaces or portions of surfaces that need to be removed in order to gain access to the noxious materials, e.g., walls that contain noxious materials or ceiling tiles that need to be removed to gain access to asbestos insulation around steam pipes, respectively. Working surfaces may also include surfaces to which a treatment or other application of any process is to be conducted.

As used herein a removable pressure sensitive adhesive is one that is normally tacky at room temperature, adheres to a surface when applied with pressure, preferably light pressure, and is substantially removable without leaving significant adhesive residue and/or with minimal visible damage to the surface. Damage to the surface may include leaving adhesive residue on the surface, removal of floor wax, removal of paint, removal or tearing of drywall paper, removal of pieces of wallboard, etc. Any adhesive according to one aspect of the present invention preferably has sufficient shear and peel strength to hold the barrier sheet material attached to the surface to be isolated until it is removed. The ability to hold such a barrier sheet in position is also based upon many other factors, including sheet size, weight and positioning, the area of the sheet coated with adhesive, the cohesive nature between the adhesive and the surfaces of the sheet and the positioning surface, and the adhesive composition and coating weight and pattern. It is preferable that adhesives be used based upon the application surface material so that after removal of the adhesive coated sheet, no more than 10% of the surface area that had been in contact with the adhesive of the adhesive coated sheet will have adhesive residue. More preferably, no more than 5% of that surface area will have adhesive residue.

The adhesive may be coated onto the barrier sheet as a continuous coating, a patterned coating, e.g., dots, stripes, polygons, logos and the like. It is useful to have the adhesive coated on at least one lateral edge of the one major surface of the barrier sheet, and also, the adhesive may be coated on both lateral edges of one major surface of the barrier sheet. The adhesive may also be coated on the lateral edges of both major surfaces of the sheet. In accordance with one aspect of the present invention, an intermediate adhesive zone is preferable because any one or more adhesion zones between the barrier sheet edges will improve barrier sheet performance by reducing billowing or sagging as may occur under environmental conditions. Such environmental conditions may result from naturally created conditions of any kind or as may be created under artificial influences like negative pressure.

The removable adhesive on the plastic sheet may cover as much of at least one major surface as needed to keep the sheet adhered to the surface until the abatement process is completed. The adhesive may cover up to about 20% of the one major surface for some applications, such as for enclosures that do not need to be subjected to reduced or increased pressure conditions. For enclosures that are subject to pressure changes, it is useful to have more than 20% of the plastic sheet surface coated with adhesive. For some abatement processes, it may be useful to have at least 50% of the sheet surface covered with adhesive, and in some cases it may be preferable to have at least 80% of the sheet surface covered with adhesive. In applications in which the enclosure must withstand the force generated by a negative pressure (and thus a billowing effect in addition to sagging), it may be preferable to have at least 90% of the sheet surface covered with adhesive, and in some instances, it may be preferable to have substantially all of one major surface covered with adhesive.

In addition to methods of creating containment spaces and of removing materials from working surfaces, the present invention further comprises the application of a barrier system to structural elements of a preexisting structure. In some cases, such structure may have one or more non-working surfaces and one or more working surfaces and a barrier sheet having first and second major surfaces, the sheet bearing a removable pressure sensitive adhesive on edge and intermediate zones, preferably covering 20% or more of its surface area. The adhesive can thus be disposed between the sheet and at least one non-working surface so as to form an enclosure to isolate a noxious or other material from the non-working surface.

Another alternative embodiment of the invention is a barrier system applicable to a structure having at least one non-working surface and one working surface, and a barrier sheet material having first and second major surfaces, the sheet material bearing a removable pressure sensitive adhesive on at least 50%, of its surface area, and the adhesive being disposable between the sheeting and the at least one working surface so as to form an enclosure to isolate and contain a noxious material.

Another alternative embodiment of the invention is a barrier system applicable to a structure having at least one non-working surface and one working surface, and a barrier sheet material having first and second major surfaces, the sheet material bearing a removable pressure sensitive adhesive on at least 80% of its surface area, and the adhesive being disposable between the sheeting and at least one working surface so as to form an enclosure to isolate and contain a noxious material.

Further, another alternative embodiment of the invention is a barrier system applicable to a structure having at least one non-working surface and one working surface, and a barrier sheet material having first and second major surfaces, the sheet material bearing a removable pressure sensitive adhesive on at least 90% of its surface area, and the adhesive being disposable between the sheeting and at least one working surface so as to form an enclosure to isolate a noxious material.

The present invention also directed to the provision of an enclosure comprising elements to isolate a space containing noxious materials. The elements include at least one working surface and a layer of barrier sheet material having a first major surface and a second major surface, and a first lateral edge and a second lateral edge, with a removable pressure sensitive adhesive, covering at least edge and intermediate zones of the first major surface of the sheet. The elements may further include: one or more other surfaces that are covered with a barrier sheeting having little or none of its surface area covered with a removable pressure sensitive adhesive; one or more working surfaces that are not covered with any plastic sheeting; or any number of temporary elements or panels. A temporary panel may be, for example, a rigid, semi-rigid or flexible plastic sheet material.

In an embodiment that is suitable for asbestos abatement or remediation, a barrier sheet is preferably made from a polymeric film suitable to contain the particulate matter, wherein at least 90% of at least one major surface bears a removable pressure-sensitive adhesive. In some cases it is useful to have at least 95% of at least one major surface bearing a removable adhesive, and in other cases it is useful to have at least 99%. The increased adhesion obtained by the greater area of the sheet covered with adhesive is preferable to reduce and preferably eliminate the occurrence of any breach of the controlled environment within the containment space, as discussed in the Background Section above.

Further, an enclosure for asbestos abatement may comprise a plastic barrier sheet having a removable pressure sensitive adhesive that desirably remains intact for a period from about three hours or so after installation and under a negative pressure of −0.01 inches of water within the enclosure. In some cases, it is desirable for the enclosure to remain intact for a period of at least 12 days after installation and under a negative pressure of −0.02 inches of water within the enclosure to meet some current regulations for asbestos abatement. Depending on any particular application, shorter time periods may need to be accommodated as well as even much longer time periods of 60 days or more.

In another aspect of the present invention, any critical openings as may be identified in the working or non-working surfaces of a structure are preferably covered with a critical cover sheet. As used herein, critical openings, also referred to herein as criticals, include windows, doorways, electrical and telephone outlets, air vents, heating vents, access panels, and the like. For purposes of this discussion, critical openings such as windows and doorways are considered to include the frame around the opening of the window or door. That is, the periphery of a window or door is preferably considered part of a critical opening, such as based upon the window or door opening and any molding that is attached around it.

A critical cover sheet refers to a barrier sheet that preferably is substantially completely covered by a removable pressure sensitive adhesive for the purpose of enhancing the cover of such critical openings. However, a suitable critical cover sheet for critical openings may only be covered partially on a first major surface with a removable pressure sensitive adhesive. For certain applications it may be useful to use a critical cover sheet that is covered with a removable pressure sensitive adhesive on at least 80% of a first major surface, and in some applications it may be preferable to use a critical cover sheet that is at least 90% covered with a removable pressure sensitive adhesive. It is preferable for the critical cover sheet to be flexible, but flexibility may not be required for all types of critical coverings. In a preferred embodiment, the critical cover sheet is sized to include a peripheral portion that will extend beyond the periphery of the critical opening, but need not cover the entire working or non-working surface. Preferably, the critical cover sheet will not also cover the entire working or non-working surface. Instead, a flexible barrier sheet as described above and coated with a removable pressure sensitive adhesive or a non-adhesive coated barrier film may be placed over the critical cover sheet to isolate the surface or to form a part of an enclosure. The adhesive of the critical cover sheet may be the same as the adhesive on the flexible barrier sheet, or it may be different, such as comprising an adhesive that is specially formulated to stick to the surface of the critical opening.

In yet another method of the present invention, at least one critical opening of a non-working or working surface within a structural element of a preexisting structure is first covered with a critical cover sheet that is substantially completely covered on one major surface with a removable pressure sensitive adhesive. Then a flexible barrier sheet that is at least partially covered with a removable pressure sensitive adhesive can be placed over the non-working or working surface, covering the previously covered critical opening in the structure. Furthermore, an enclosure may be formed using the barrier sheet that has already been applied to the non-working or working surface and using one or more other adhesive coated or non-adhesive barrier sheets on other non-working or working surfaces. The enclosure can thus comprise a working surface containing noxious materials to be isolated for removal, while specifically isolating critical openings that may be present on working or non-working surfaces to prevent escape of the noxious materials.

A barrier sheet in accordance with the present invention is preferably polymeric and flexible for ease of application to a working surface and ease of handling the sheet. For some applications, it may be useful to include a flame retardant material in or on the sheet, within the removable pressure sensitive adhesive, or both. A flame retardant in the sheet may be a coating on one or both major surfaces of the sheet, or it may be compounded into the material used to make the polymeric sheet.

DETAILED DESCRIPTION

Figure 1:
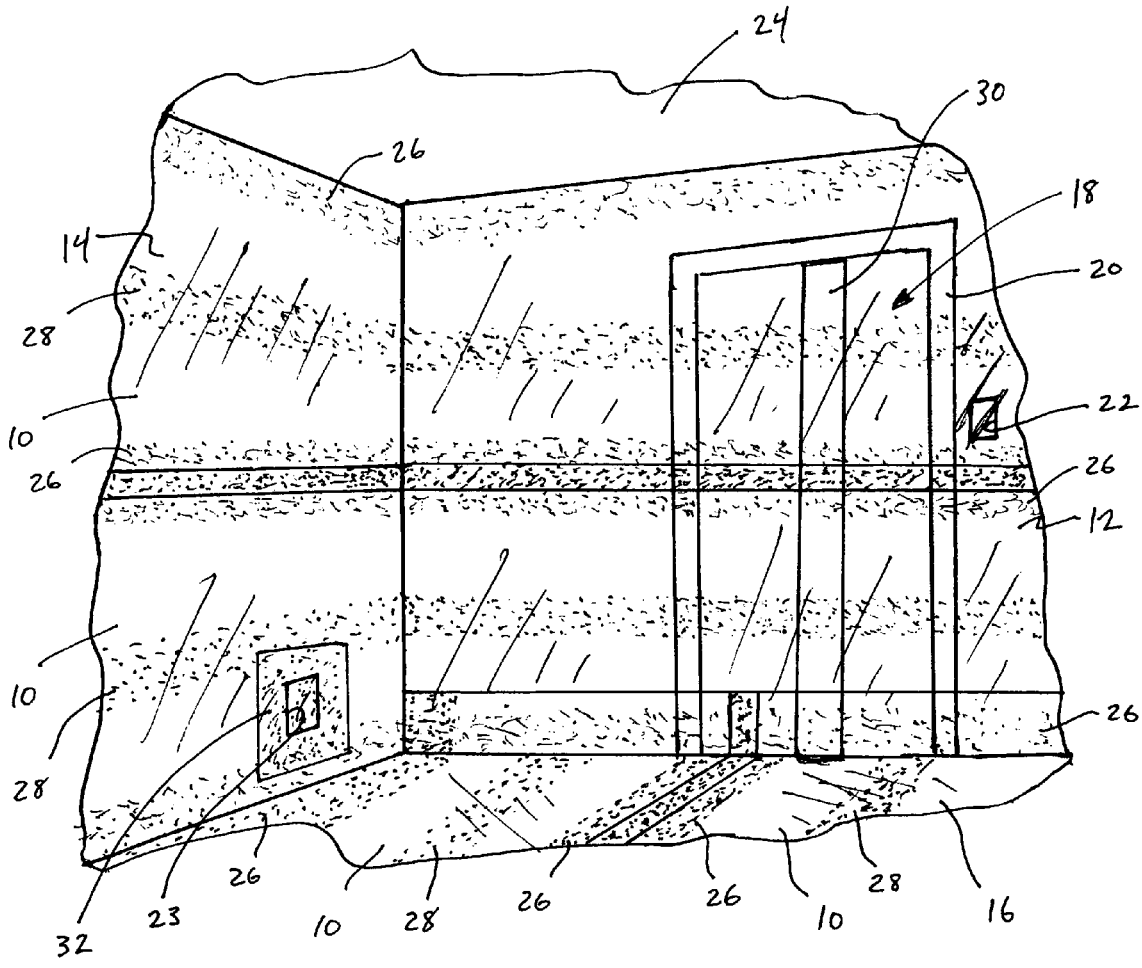
FIG. 1 shows an example of a room having a working surface and non-working surfaces, wherein the non-working surfaces and critical openings are covered by plural barrier sheets in accordance with the present invention, the barrier sheets each having a holding system comprising adhesive zones at edge and intermediate zones.

Methods and systems in accordance with the present invention can be used to abate or remove physical material, such as including particulate matter, from buildings, ships, aircraft, recreational vehicles, tunnels, or other spaces by providing an isolated space. Likewise, such methods and systems are useable during the application of material (in gas, liquid or solid phase) to one or more structural elements or to the use of controlled material within a contained space of an enclosure. The present invention finds particular applicability to any situation where a controlled environment is created within a contained space as based at least in part on structural elements of preexisting structure. A controlled environment may relate to its cleanliness, pressure, temperature, air flow, and the like, where any such conditions is to be preferably controlled for a period of time for the purpose of conducting another operation with such space under controlled conditions. The environmental conditions may result from any natural or artificial causes. A preexisting structure may comprise any number of structural elements including permanent or temporary components that form a basis for creating a contained space. Non-limiting examples of where and when methods can be used are: certain phases of building construction when it is desirable to isolate certain areas from dust contamination by containing the dust within an enclosure; remediation of asbestos in buildings; isolation of radioactive particles; and mold removal. Another non-limiting example of where this isolation system can be employed is to construct chambers in a medical facility to contain contagious viruses or bacteria to protect against the spread of disease.

Methods in accordance with the present invention include the basic steps of providing a barrier sheet having first and second major surfaces and securing the barrier sheet material to a surface or surfaces of one or more structural elements of the area to be isolated. As used throughout this application, the term structural element means any different component or element that together make up a structure, including for example multiple walls, floors, ceilings, doors, windows or the like, or those components that can make up any wall, floor ceiling, door, window or the like. For example, a vent and wall or a window frame and window are considered different components even though both may be components of a wall or window.

Thus, a barrier can be created between structural elements for forming an enclosure at least partially around a working space or a working surface such as may comprise a noxious material or may contain a noxious material. The barrier sheet may be provided in various forms such as folded or unfolded sheets, rolls, and combinations thereof. The barrier sheeting can be secured to an internal or external surface or surfaces of such structural elements, whether part of a preexisting structure or including new or temporary additional structure. That is, any such structural component(s) or portion thereof can be inside the enclosure or outside the enclosure depending on whether the barrier sheeting is secured to internal or external surface portions of the structural component(s).

For securing the barrier sheeting to the one or more structural component surfaces, it is an aspect of the present invention to provide a holding system as at least a part of the manner of securing the barrier sheeting to a surface that is integral with a surface of the barrier sheeting. Preferably, such a holding system is provided to the barrier sheeting along at least an edge portion thereof and one or more intermediate portions thereof for securing the barrier sheeting to a surface of a component at edge and intermediate locations. That way, the barrier sheeting is securable to structure at multiple points over one of its major surfaces to reduce the possibility of undesirable release of the barrier sheeting from structural surfaces. Depending on the application and environmental conditions of any particular enclosure or partial enclosure, such barrier sheeting can be provided with greater or lesser holding system power.

The holding system itself is preferably provided as incorporated with the barrier sheeting, meaning that the holding system is provided as a component of the barrier sheet material as it may be applied to one or more structural surfaces.

The holding system may be actually formed with the barrier sheeting, such as by making the barrier sheeting as an extruded or cast film with one or more formed components of an interlocking fastener system. Such fastener systems are well know and conventional as comprising a component that interlocks with a corresponding other component that may be provided on another element. For example, a component of a zipper type fastener can be formed with a film to provide a barrier sheet and the other interlocking component can be provided to a strip, tape or other film that itself may be attachable to a surface, such as by mechanical fasteners (e.g. staples, nails, etc.) or bonding (adhesives or weld bonds). In accordance with the present invention, such a system would preferably include a holding system at least an edge portion of the barrier sheet and one or more intermediate locations.

Otherwise, the holding system can be integrated with a barrier film as being applied to or attached with the barrier sheet material along a major surface thereof. As examples, a zipper system, hook and loop fastener system or other mechanical interconnect system, as are well known or developed, can be applied to a barrier sheet major surface by a bonding (adhesive or weld) technique. As further examples, transfer tape or double sided tape can be utilized as the holding system that when adhered to the barrier sheeting provides the integral barrier film and holding system in accordance with the present invention. As above, it is preferred that any such holding system be provided along at least an edge portion of a major surface of the barrier sheeting and over at least one intermediate portion of the same major surface of the barrier sheeting.

A preferred embodiment of the present invention includes the provision of pressure sensitive adhesive as an integral component of a barrier sheet material. More preferably, such pressure sensitive adhesive is provided to a major surface of a barrier sheet material along at least an edge portion thereof and one or more intermediate locations for securing the barrier sheeting to multiple surface portions of structural components in creating a partial or complete enclosure. As described in greater detail below, the application of pressure sensitive adhesive to a barrier material, such as a film, can be accomplished in accordance with known coating or forming techniques for applying the adhesive over all or any portion of the barrier sheet major surface. For the purpose of an understanding of many aspects of the present invention described below, this preferred embodiment of the present invention is discussed with an understanding that any of the other holding systems discussed, contemplated or suggested above can otherwise be substituted for the pressure sensitive adhesive as provided to a barrier material for the purposes of creating an enclosure or portion thereof. It is further contemplated that any combination of holding systems can be used selectively in accordance with the present invention over one or more surface portions of a major surface of a barrier material in creating a suitable barrier sheet.

For convenience, barrier sheets in accordance with the present invention will be described in terms of a roll of barrier sheeting, such as comprising a polymeric film, that may be wound with an adhesive coated surface facing inward so that the sheet material itself protects the adhesive and in particular that of the outermost wrap. The adhesive surface may alternatively be wound facing outward, in which case a protective release liner may be attached to the adhesive surface of the outermost wrap to protect it from contamination. A liner may be used, if desired, in any case whether rolled inward or outward. An adhesive coated barrier sheet preferably has sufficient adhesive coverage in a sufficient amount (thickness or coating weight) on its surface(s) to prevent the sheet from pulling away from an intended surface during use, and is preferably removable from the surface when environmental control is no longer needed, such as after the abatement or removal of noxious materials is completed. A suitable adhesive preferably also is one that according to the coating manner and coating variables is of sufficient cohesive force for the intended application surface, and it is contemplated that different adhesives may be utilized based upon different intended application surfaces (e.g. for wood, metal glass, plastic, etc.).

The barrier sheet can tend to pull away from any surface to which it is attached for various reasons. For example, a pulling force can cause the barrier sheet to lose adhesion if the weight of the sheet material overcomes the adhesive force needed to keep it adhered to the surface(s), or when a partial vacuum is generated inside of the enclosure to contain noxious particulate material to prevent it from escaping into the surrounding area. As described in the Background Section above, under a partial negative vacuum within an enclosure, a barrier sheet with any significant portion without adhesive coating or that is taped to a wall at the edges will tend to billow away from the wall. This in turn can cause the sheet to pull away from the surface and collapse part or all of the enclosure. The barrier sheets can be subject to many other forces or conditions that can adversely affect adhesion including the application of a direct or indirect force, whether as a positive or negative force, or by conditions, such as temperature, humidity, light, and the like. The adhesive used or amount coated (percent coverage, coating pattern and/or coating weight) may be chosen as well for such conditions.

In the practice of the invention, the barrier sheet material preferably has a sufficient amount of adhesive and of the appropriate type of adhesive for the surface to which the barrier sheet will be attached. While it is desirable in some cases to have the sheet material substantially completely covered by a removable pressure sensitive adhesive, complete coverage is not necessary, as long as the adhesive that is present has sufficient holding power to keep the enclosure intact for the duration it is needed and under the expected conditions. By substantially completely covered, it is meant that at least 95% of the surface of the sheet material is covered by the adhesive. In some cases a film that is only partially coated on at least one of its major surface(s) will suffice. This may be true when partial vacuum is not to be generated within the enclosure or when the enclosure will be up for a short period.

In accordance with the present invention, it is desirable that at least 20% of the surface area of the sheet be adhesive coated and that adhesive zones be provided at least along an edge portion and an intermediate portion to reduce billowing. In some cases it is desirable that at least 50% of the surface area of the sheet is adhesive coated, and in some cases it is desirable that at least 80% of the surface area of the sheet is adhesive coated. The adhesive may be coated in a continuous coating, in a discontinuous pattern, or a combination thereof. It is generally desirable to have a continuous coating of the adhesive along a lateral edge on at least one major surface of the sheet to provide a seal between a surface and the sheet. A sheet that is adhesive coated along one lateral edge on one major surface may further include an adhesive coated in a random or ordered pattern on one or more intermediate portions or entirely over the sheet major surface.

In one embodiment, the barrier sheet forms an enclosed space so that the noxious material is contained within the enclosed space. Particulate materials can subsequently be removed, for example, by filtering the air within the space through an appropriate particulate filter, misting the area with water and vacuuming or wiping to remove the particles, or encapsulating the particulates with film forming materials. In some cases, it may be useful to enclose and seal off the space with one or more barrier sheets in accordance with the present invention, and then to apply a negative pressure within the enclosed space to prevent the particulates from escaping from the space. The negative pressure may cause some billowing of the barrier sheet from the surface, although it is desirable to reduce such billowing. Billowing can be acceptable as long as the enclosure remains intact, e.g., it does not fall down, collapse, tear, pull away form the surface, etc. during the time it is needed. It is preferable to use adhesive coated plastic sheet material as the barrier sheet that substantially reduces or minimizes billowing. For abatement of asbestos or the like, it is useful that the enclosure should remain intact, e.g., maintain an isolated space, under a negative pressure of 0.02 inches of water, measured by a continuously recording manometer, as required by current regulations for asbestos abatement.

The invention also relates to a system of abatement of physical materials (including noxious or any other materials where controlled removal is desired) having an isolated space formed, at least in part, by a barrier sheet, that is at least partially coated on at least one major surface with a removable pressure sensitive adhesive, so that the barrier sheet can be adhered to at least one surface surrounding the isolated space at edge and intermediate zones. The space may be entirely surrounded with the adhesive coated barrier sheet, partially surrounded with the adhesive coated barrier sheet, or it may have the adhesive coated sheet on one surface while the remainder of the enclosure is formed by non-adhesive coated film. The surfaces surrounding a space can include permanent structures, such as walls, ceilings, and floors or temporary structures, such as temporary walls or supports provided just to define the desired enclosure space.

For convenience, the following invention aspect is described using, as a non-limiting illustration, asbestos abatement in a conventional structure having four walls, a floor, a ceiling, and critical openings, i.e., windows, a door, light switches, heating vents, cold air return vents, phone jacks, and power outlets. In such example, a barrier sheet material that is preferably completely covered with a continuous coating of a pressure sensitive adhesive and that is removable from a painted drywall surface can be used. The exposed wall and floor surfaces of the room are sealed off with adhesive coated barrier sheets to form an enclosure with a controlled internal environment; a negative pressure is generated within the enclosure to prevent escape of the asbestos particles and to exhaust the air from within the enclosure out through a duct connected to a filter; the asbestos is removed by collecting in the filter; all of the exposed surfaces of the enclosure are washed with an aqueous solution, and the barrier material is removed in compliance with asbestos abatement regulations. One suitable barrier sheet material is a 0.006 inch thick low density polyethylene (LDPE) sheet, with or without fire retardant, that is coated on one side, i.e., one major surface, with a removable pressure sensitive adhesive. A suitable product is commercially available as product no. 10WH06 from Bearacade Products LLC, of Forest Lake, Minn.

In FIG. 1, a room as described above is illustrated having a plurality of barrier sheets 10 in accordance with the present invention covering many different structural components including walls 12 and 14, floor 16, a critical opening 18 defined by the door frame 20, a light switch opening 22, a power outlet 23 and a temporary structure element 30. Each of these elements presents non-working surfaces of the illustrated room that are covered by the barrier sheets 10 to form an enclosure for abatement of a working surface that comprises, for example, the ceiling 24. Each barrier sheet 10 is shown as having adhesive edge zones 26 and adhesive intermediate zones 28 as a holding system in accordance with the present invention. The barrier sheets 10 are shown on the walls 12 and 14 and other vertical surfaces of the door frame 20 and temporary structure element 30 and covering openings 18, 22 and 23 in a horizontally overlapping relationship to one another. Power outlet opening 23 is also illustrated with an adhesive coated piece of barrier sheet 32 covering the opening under the barrier sheets 10. Barrier sheets 10 covering the floor 16 are also shown overlapped with one another and covering the lower portion of wall 12 and opening 18.

As an example, the asbestos can be located above the ceiling as insulation around hot water pipes. In practice, the critical openings within the room, as discussed above, are preferably each covered with a piece of fully adhesive coated sheet so that the piece extends past the peripheral edge of each opening with sufficient adhesive force to maintain the seal when a negative pressure of 0.02 inches of water is generated within the sealed room. Typically, the piece may extend two to six inches past the edge, or the edges may be secured with tape, for example, duct tape. Preferably, a substantially completely adhesive coated sheet is used for both the critical openings and the walls with the critical openings so that the critical coverings are even better situated to remain in place. The adhesive coated sheeting on the walls provides additional support for the critical coverings while the enclosure is under negative pressure. Next, a floor can be prepared by preferably laying down two layers of adhesive coated barrier sheet on it. The first layer of sheeting is applied by adhering the leading edge of a roll of sheeting to the floor adjacent one wall, unwinding the roll across the floor and adhesively securing at least intermediate adhesive zones of the sheet to the floor, and cutting off the sheet when the opposite wall is reached. When the sheet material is provided in rolls having widths that are narrower than the width of the room, multiple strips can be laid, for example, approximately parallel to each other on the floor with the lateral edges of each strip overlapping the adjacent strip to provide sealed seams. Where the adhesive is coated over the sheet on a major surface thereof (as a pattern or totally), the intermediate zones and edge zones fully hold the barrier sheets in place to the floor and all edges.

The walls can then be covered by attaching sheets of the adhesive coated sheet with overlapping seams to seal the room from the ceiling to the floor. The width of the rolls used to cover the various parts of the enclosure can vary from wide to narrow depending upon the size of the area to be covered. For example, on wide hallways and walls, rolls 60 inches wide and wider may be used, and in narrow areas, rolls as narrow as 4 inches may be advantageous. A roll of sheet may be applied either horizontally, e.g., the lateral edges of the sheet are nearly parallel to the floor, or vertically, e.g., the lateral edges of the sheet are nearly perpendicular to the floor. Other angular or non-regular application methods are also contemplated. In general, it may take less time to apply the sheet in horizontal placement because fewer individual strips would be required. Horizontal placement is most suitable for long hallways and long rooms. Vertical placement may be desirable for rooms with high ceilings. Additionally, vertical placement is preferred when the receiving surfaces are porous or textured. The adhesive coated films preferred according to this invention tend to adhere more readily to smooth flat surfaces than textured or porous surfaces. Ceramic tile walls and walls constructed with drywall materials are examples of surfaces where horizontal placement of the film may be preferred and concrete block walls are an examples of where vertical placement may be preferred. To complete the enclosure, a second layer of floor sheeting is preferably adhered over the entire surface of the first sheet and extending up the wall and overlapping the wall sheet to make a more effective seal at the floor to wall juncture. A typical overlap of the floor sheet over the wall sheet is about 12 inches. Preferably, if multiple strips of sheeting are needed to form a second layer of floor sheeting, the strips of the second layer are applied at approximately a 90-degree angle to the first layer to avoid having seams line up on top of each other. A door opening can be sealed with one layer of an adhesive coated sheet, and optionally or as required, an appropriate one-way air valve can be installed. According to this example, the ceiling would be considered a working surface (where abatement is to take place) and thus would not be covered. A negative pressure of about 0.02 inches of water is then generated within the enclosure by providing, for example, a duct and fans to continuously draw air out of the room and through a particulate filter to provide the needed negative pressure. Creases that may have been formed during the application of the wall and floor sheeting may open to form tunnels which can become larger with time. Tunnels can be easily eliminated by pressing on them to reseal the crease. Pressure sensitive adhesive is preferably provided to be sufficient to close the tunnels and prevent them from enlarging. The pressure within the enclosure may be monitored using a continuously recording manometer. After the enclosure is completed, the asbestos or other physical material, which is typically found in a variety of building materials, can be removed. Following removal, the exposed surfaces of the sheet may be washed with water, or sprayed with water and mechanically vacuumed. Finally, the enclosure can be removed by pulling the sheets away from the walls and floors.

Methods of the present invention provide for a faster way of forming an enclosure. The labor-intensive steps of spraying adhesive as a primer onto the wall, taping, and mechanically tacking the sheets onto the walls are eliminated. When a construction project requires asbestos abatement as part of the project, all other phases of the project are delayed until the asbestos removal component is completed. The methods taught by this invention significantly reduce the time required to complete the removal of asbestos, and consequently the entire project is shortened, which can result in a considerable reduction in labor costs. On some jobs the time to complete the abatement phase can be reduced by 75%.

During the abatement process, negative pressure inside the enclosure can cause the walls of prior art enclosures to billow out away from the walls. As described above in the Background Section, this can cause the duct tape to peel away from the wall or floor causing the sheet in some part of the enclosure to be subject to puncture or tear from workers' tools or pull away completely and collapse, or partially collapse, the enclosure. Such a containment failure, and possible escape of particulate matter, creates a breech of containment which is a reportable violation under some state regulations.

Methods in accordance with the present invention, provide enclosures that are less likely to pull away or billow from the walls when negative pressure is created within the isolated space, creating a more safe and more secure enclosure, and a more efficient workspace. When using these methods, the negative pressures generated in the enclosure can be significantly increased, e.g. to about 0.04 inches or more of water, to provide additional assurance that the containment will be safe. An enclosure of the present invention is also easier to clean because the sheet surfaces are adhered tightly to the wall and floor surfaces so that they can be washed with water and mechanically vacuumed.

Further, when there is a negative pressure within the enclosure, creases that were formed during the application of the wall and floor sheeting may open to form tunnels. However, pressing on the creases reseals them and avoids the formation of tunnels.

While specific requirements need to be met for the sheet for asbestos abatement, the invention contemplates the formation of enclosures for isolating surfaces from other noxious contaminants or any other physical material that do not have as stringent or any regulatory requirements, as do the enclosures for asbestos abatement, e.g., the thickness of the sheet or fire retardants in the sheet. Further, enclosures may not require the entire sheet to be adhered to a wall. For example, an adhesive coated sheet is attached to the opposing walls of a hallway, but the open ends of the hallway can be enclosed with a non-adhesive sheet. Additionally, not all enclosures need to maintain a negative pressure so the adhesion requirements can be lower for some uses, such as nuisance dust isolation.

In one barrier sheet embodiment of the invention, a barrier sheet can be coated along at least one lateral edge portion of one major surface and at least one intermediate portion of the same major surface with a pressure sensitive adhesive.

In another barrier sheet embodiment of the present invention, the barrier sheet can be coated along both lateral edges and an intermediate zone of one major surface with a pressure sensitive adhesive on one major surface.

In yet another embodiment, the sheet can be coated along one or both lateral edges of both major surfaces.

In still another embodiment of the invention, a strip of the adhesive coated sheet acts can be utilized as a "target tape" that is removably adhered to a surface, and a barrier sheet can then be attached to this target tape. The barrier sheet itself may or may not be adhesive coated or provided with any holding system of any kind. For example, the target tape may be applied to the wall adjacent to the ceiling and preferably to one or more at least an intermediate regions of the surface, and a barrier sheet can then be attached to the target tape with a tape, e.g., duct tape, with an adhesive that may be either a removable adhesive or one that adheres permanently to the target tape, or directly with any adhesive or other holding system discussed or suggested above. In this embodiment, the a target tape having adhesive coating can be preferably two to twelve inches wide to provide sufficient holding power. Such a target tape system may be provided and used selectively. That is, a target tape may be used at one of an edge portion or intermediate portion and not at another portion that may instead have a different holding system used there.

As yet another alternative, a target tape can be utilized for adhesion and surface release purposes. For example, it may be desirable to cover and adhere a barrier sheet to a surface of a certain material that may have release properties different from that for which the barrier sheeting is particularly designed or the barrier sheet may be adhered to multiple different surfaces. The barrier sheet may include a pressure sensitive adhesive that was provided with an expectation for adhesion to one type of surface with a more or less aggressive adhesion than with other surfaces that may also be encountered in constructing an enclosure. So, a target tape or film portion can be provided with a different adhesive that is better suited for the surface to be covered for adhering and/or releasing better, and then a barrier sheet can be adhered to the outside surface of the target tape. That way, the target tape with adhere and/or release as desired from the covered surface. As above, the use of such target tapes or films can be done selectively as needed.

Suitable barrier sheet materials include polymeric films that can be made from any polymeric material that can be formed into a sheet including, as non-limiting examples, polyethylene, e.g., low density, linear low density, medium density, high density, and blends thereof; polypropylene; polyester; polyvinyl chloride; nylon; and polycarbonate.

While the thickness of the sheet may be 0.030 inch or more, it may be desirable to choose sheets below about 0.010 inch for cost considerations, or when it is desirable that the sheet be more flexible. In general, it is desirable to have the sheet material as thin as is feasible, but compliant to any regulatory considerations in such cases as asbestos removal, which requires at least 0.006 inch sheet in some cases. In general the combined properties of the sheet and the adhesive, e.g., tensile, stretch, thickness, flexibility, etc., can provide the properties needed to handle the sheet, e.g., the ability to pull the sheet off of a roll and apply it without excessive wrinkling. In some instances, thinner sheets or films are desirable, e.g., less than about 0.010 inch, and more desirably less than about 0.007 inch, because thinner films are less costly, are less likely to pull away from a surface from its own weight, and the flexibility increases contact of the adhesive to the surface by conforming to irregular surfaces. Preferably sheet thickness can range from about 0.001 to about 0.008 inch.

Sheets useful for the invention may also include additives in the amounts suitable for their end use. Examples of additives include flame-retardants such as antimony oxide, ammonium sulfamate, zinc borate, antimony oxychloride, ammonium bromide, hydrated aluminum oxide, phosphonitrilic chloride, bromonated alkoxydiphenyl sulfone, chlorendic anhydride, chlorinated paraffins, dyes, pigments such as carbon black, and fillers such as calcium carbonate, talc, and silica. Such additions may be applied as a coating or within a layered construction, or may be blended or otherwise incorporated within the adhesive, film structure or other material composition.

The barrier sheeting for sealing critical openings or other enclosure surfaces may be of many different widths and can be applied using a mechanical dispenser as supplied from a continuous rolls of sheeting or from a stacked pad or pieces of adhesive coated sheeting with or without release liner that is to be removed prior to the barrier sheet being applied to a surface. The adhesive coated barrier sheet of this invention may be opaque, translucent, transparent, colored, printed, or natural. When a sheet is used that is difficult to see through, a transparent window, of non-coated or adhesive coated transparent sheet material, may be applied over a hole cut in the sheet in at least one wall portion to aid workers, supervisors, and inspectors to see into and out of the enclosure. Also, the backside of the floor sheet may be provided with a feature to increase foot traction and reduce slippage, especially when wet, e.g., textured surfaces or added grit.

A suitable adhesive is one that adhesively secures the sheet to any surface during the enclosure process. It is also desirable that the adhesive be removable from the surface after the enclosure process, typically from one to 60 days after initial application, such as to accommodate an abatement process. Suitable pressure sensitive adhesives are acrylic adhesives, block copolymer natural or synthetic rubber adhesives, polyvinyl alcohol, polyvinyl acetate, polyurethane, and adhesive blends. Fillers may also be incorporated in adhesives to enhance physical properties and lower costs and crosslinking agents may be added to increase the cohesive strength of the adhesive. The selection of an appropriate adhesive is somewhat unique to the surface that the adhesive must adhere to Formulations can be provided by those skilled in the adhesive arts.

Logo, indicia, or other printing may be added to the adhesive coated sheet for identification, detackification of specified adhesive areas, or instructional purposes.

The adhesive may be coated as a continuous layer onto the plastic sheet, i.e., with 100% coverage, or it may be coated on only portions of the sheet. The adhesive may be coated in regular, i.e., defined, patterns, or irregular, i.e., random, patterns, or a combination of both regular and irregular patterns. For example, it may be coated in stripes (e.g., straight stripes along the length or width of the sheet, wavy lines, cross hatch or grid patterns, etc.), spots (e.g., dots, geometric shapes, alpha numeric shapes, etc.), or combinations thereof. For example, a plastic barrier sheet may be coated on the lateral edges of one major surface with a continuous coating, while a central portion of the sheet may be coated with regular or irregular spots.

The value, uniqueness, and utility of the present invention are further illustrated in the following non-limiting examples.

EXAMPLES

Comparative Example 1

Standard Industry Method

A low nap industrial grade carpeted room measuring approximately 17 feet by 17 feet with painted drywall construction was prepared as a containment enclosure for the removal of asbestos according to standard industry practice.

Step 1—Covering or Sealing of the Critical Areas of the Containment.

A 0.006 inch thick fire retardant low density polyethylene sheet was cut to appropriate sizes to sufficiently cover and seal seven electrical service outlets, two light switches, two 36 inch by 60 inch window openings, three 24 inch by 24 inch ceiling ventilators, and four 24 inch by 24 inch fluorescent ceiling lights. The cut pieces of plastic sheet were sized four inches wider than the opening to be covered in the length and width directions, and were attached over the openings and secured to the surrounding wall using two inch wide duct tape, Nashua No. 398, manufactured by Tyco Adhesives, Norwood, Me.

Step 2—Application of Wall Sheet

The wall was covered from floor to ceiling with 0.006 inch fire retardant low density polyethylene sheet manufactured by Polar Plastics, North St. Paul, Minn., as follows. To facilitate the application of the wall sheet and to insure good bonding of the duct tape, spray adhesive, Spray Tac No. 04320 manufactured by Grayling Industries, Inc., Alpharetta, Ga., was sprayed, as a primer, approximately two inches from the ceiling, in a continuous pattern approximately four inches wide around the perimeter of the room. Next, a piece of the polyethylene sheet, 20 feet wide, was unfolded. While standing on a ladder the workman began to cover the walls by adhering the edge of the sheet to the area of the walls that had been sprayed with adhesive. To prevent the sheet from falling, short strips of duct tape were intermittently taped over the sheet to the wall. To provide for a more secure seal and attachment, a second continuous strip of duct tape was applied over the intermittent strips. The lower end of the draping sheet was then taped to the baseboards.

Step 3—Application of Floor Sheet

Two layers of 0.006 inch of fire retardant polyethylene sheet were used to cover the floor. The first layer was attached to the floor, adjacent to the baseboards, with duct tape. The second layer of sheet was oversized and attached in such a manner that the sheet covered the entire floor and extended up the wall overlapping the wall sheet at least 12 inches. The floor sheet is secured to the wall sheet by applying duct tape to the overlapped areas to provide a seal at the floor sheet—wall sheet juncture.

Step 4—Creating Negative Pressure in the Containment

A fan was placed in the doorway of the room and the openings around the fan were covered with 0.006 inch fire retardant LDPE sheet using duct tape to attach the sheet to the frame surfaces of the door and to the exterior surfaces of the fan frame. To allow air into the containment area, a one-way air valve, commonly called a "Z Flap," was created in the sheet covering the doorway. A negative pressure of −0.02 inches of water was created and maintained, by manipulating the size of the air valve, and maintained while the fan was operating in an exhaust mode. The pressure was monitored using a continuous recording manometer.

Step 5—Final Cleaning of the Containment

The asbestos containing material was removed. The interior exposed surfaces of the enclosure were cleaned using mechanical vacuuming, and washing all surfaces with water.

Step 6—Disposal of Containment Materials

All materials used to fabricate the containment were carefully removed, folded in upon themselves, compacted, and placed in large plastic bags for disposal.

Example 2

Two Layer Enclosure Using Adhesive Coated Sheeting of the Present Invention

A low nap industrial grade carpeted room measuring approximately 17 feet by 17 feet with painted drywall construction was prepared as a containment enclosure for the removal of asbestos. Each of the barrier sheets as applied and discussed below comprised a 0.006 inch fire retardant pressure sensitive, releasable, adhesive coated LDPE (low density polyethylene) sheet, available from Bearacade Products LLC, Forest Lake, Minn., as product number 10FR06A-28200 substantially completely covered with an acrylic type pressure sensitive adhesive.

Step 1—Covering or Sealing of the Critical Areas of the Containment

A barrier sheet material as described above was used to cover and seal the following openings: seven electrical service outlets, two light switches, two 36 inch by 60 inch window openings, three 24 inch×24 inch ceiling ventilators, and four 24 inch×24 inch fluorescent ceiling lights. The critical openings were covered and sealed by placing or holding a roll of adhesive coated sheet below the opening to be covered, and upwardly pulling the sheet from the roll to a point sufficiently above the opening, at which time the sheet was cut, and then wiped down to adhere it against the wall and over the opening. To insure a good seal, the widths of rolls were selected to insure that the openings were covered with excess sheet on all four sides of the opening. The sheet covering the windows was 12 inches wider than the window opening, the sheet covering the light switch openings and electrical outlets was 4 inches wider than the opening, and the sheet covering the lights and ventilators was 4 inches wider than the opening.

Step 2—Application of First Layer of Floor Sheet

A first layer of 48 inch by 0.006 inch pressure sensitive releasable adhesive coated, fire retardant LDPE sheet was used to cover the floor. The first layer was adhesively attached to the floor by starting at the juncture of the wall and floor and unwinding the roll of coated sheet material to the other end of the floor. A second length of adhesive coated sheet material was then attached parallel to the first sheet with 3 inch overlap. The process was repeated until the entire floor was covered. The sheet was then wiped down to insure that it was adequately attached to the floor.

Step 3—Application of Wall Sheet

The wall was covered using 48 inch wide by 0.006 inch pressure sensitive releasable adhesive coated fire retardant sheet, by applying the sheet to the walls in a horizontal configuration. Starting at one corner of the room and near the bottom of the wall, the sheet was attached to the wall with approximately 12 inches of overlap onto the carpet. This was done by placing the adhesive side of the leading edge of the roll against the wall and wiping it down with a soft bristle brush to achieve anchorage of the sheet to the wall, thus allowing the roll to be unwound by pulling and simultaneously attaching the sheet to the wall. In this manner one wrap of sheet was applied to the perimeter of the room with approximately 12 inches of the width extended onto the floor. This process was repeated upwardly, with approximately 3 inches of overlap at the seams, until the wall was covered from floor to ceiling. The sheet was then wiped down with brushes to maximize the surface area of contact between the sheet and the wall. In addition, care was taken to insure that the wall sheet was adhering to and around the peripheral areas of the sheet covering the critical openings.

Step 4—Application of Second Layer of Floor Sheet

A second layer of floor sheet, of the same construction as the first layer of floor sheet, was applied 90-degrees to the first layer in parallel overlapping lengths using the method described in Step 2. The length of the second layer of floor sheet was such that the ends extend approximately 12 inches up the walls, which results in a 24" overlapping joint with the wall sheet. The process was repeated until the entire floor was covered.

Step 5—Creating Negative Pressure in the Containment

A fan was placed in the doorway of the room and the openings around the fan were covered with 0.006 inch pressure sensitive releasable adhesive coated fire retardant LDPE sheet that was attached to the frame surfaces of the door and to the surfaces of the fan frame. To allow air into the containment area, a one-way air valve, commonly called a "Z-Flap," was created in the sheet covering the doorway. A negative pressure of −0.02 inches of water was created and maintained while the fan was operating in an exhaust mode.

Step 6—Final Cleaning of the Containment

Cleaning of the enclosure was accomplished by mechanical vacuuming, and washing of all surfaces with water.

Step 7—Disposal of Containment Materials

All materials used to fabricate the containment were carefully removed, folded in upon themselves, compacted, wrapped with pressure sensitive adhesive coated sheet, and properly disposed.

Various tests and observations considered important to the asbestos abatement industry were performed on the installations described in Reference Example 1 and Example 2. The data in Table 1 show the results of these tests and observations, and illustrate the advantages of the enclosure of the present invention.

1. The installation time was the time needed to complete the enclosure.
2. A negative pressure of 0.02 inches of water was applied within the enclosure. Within 60 minutes of applying the pressure, billowing of the plastic sheeting was noticed in both installations on the wall and the floor. The amount of billowing was measured as the maximum distance the plastic sheeting protruded from the wall.
3. The installation was monitored for several days and data and comparisons were reported after approximately 48 hours under negative pressure.
4. The pressure within the enclosure was further reduced to −0.04 inches of water to evaluate the stability of the installation.
5. The wall and floor surfaces were examined to determine the amount of damage to the surfaces after the enclosure was removed.
6. The clean up and disposal of the plastic sheeting for both installations was accomplished by washing down the walls and vacuuming using a standard wet and dry vacuum. The sheeting was disposed of by compressing into a mass and inserting into a disposal bag.
7. The efficacy of the installations were compared by assessing the quality of the seal, the safety of walking on the covered floor, and the general ability of the method to conform to asbestos abatement regulations of the State of Minnesota. The quality of the seal was judged to be poor if the sheeting detached or fell off under a negative pressure.

TABLE 1

Comparison of Results

| | | Reference Comparative Example 1 Standard Method | Example 2 Invention Method |
|---|---|---|---|
| Installation Time | | 114 minutes | 60 minutes |
| Billowing - under pressure of −0.02 inches water | Wall | More than 2 feet; sheet fell off wall | Spotty, less than 2 inches |
| | Floor | About 1 foot | Spotty - less than 1 inch |
| Two-day stability | Wall | Reattached twice | Remained attached |
| | Floor | Corner areas detached | Remained attached |
| Stability - under pressure of −0.04 inches water | Wall | Sheets immediately fell from the wall | Still attached after 14 days |
| | Floor | Sheets immediately billowed up from the floor | Still attached after 14 days |

TABLE 1-continued

| Comparison of Results | | | |
|---|---|---|---|
| | | Reference Comparative Example 1 Standard Method | Example 2 Invention Method |
| Damage | Wall | Significant removal of paint from the wallboard surface where duct tape was applied | Negligible amounts of paint removed |
| | Floor | None | None |
| Adhesive Clean Up | Wall | Significant amounts of duct tape adhesive were left on the walls | Negligible - sheets removed easily with adhesive remaining adhered to the sheets |
| Cleanup and disposal | Vacuuming | Difficult on billowed sheet | Remained flat for easy use of vacuum cleaner |
| | Wash down | Easy | Easy |
| | Disposal | Somewhat difficult to place in bag when compressed | Sheeting stuck to itself when compressed; remained compact |
| Efficacy | Seal quality | Poor | Excellent |
| | Floor safety | Slippery-top sheet slid on bottom sheet | Not slippery |
| | Regulations | Does not conform | Conforms |

Comparative Example 3 and Example 4 in Accordance with the Present Invention

Single Layer Enclosure Using Non-Adhesive Coated Sheeting and Adhesive Coated Sheeting A room with a concrete floor measuring approximately 10 feet by 20 feet with a painted sheetrock wall (drywall) construction was prepared as a containment enclosure for the removal of asbestos using non-adhesive coated sheeting as Reference Example 3 and using adhesive coated sheeting in accordance with the present invention as Example 4. In both cases a single layer of sheeting was used to cover the walls and floor.

Comparative Example 3

Single Layer of Non-Adhesive Coated Sheeting

The room was prepared using a single layer of non-adhesive coated sheeting as described in Reference Example 1. A single layer of sheeting was attached to the wall surfaces covering all critical openings and wall using duct tape around all edges. The floor was also covered with a single layer of non-adhesive coated sheeting and attached with duct tape.

Example 4

One Layer of Adhesive Coated Sheeting

A single layer of adhesive coated sheeting material was attached to the wall surfaces covering all critical openings and wall surfaces at the same time, using the techniques described in Example 2. The floor was also covered with a single layer of non-adhesive coated sheeting.

After each of the installations were completed, a negative pressure of −0.036 inches of water was created and maintained within the enclosure. Observations and results are displayed in Table 2.

TABLE 2

| Comparison of Results | | | |
|---|---|---|---|
| | | Reference 2 Comparative Example 3 Non-adhesive coated | Example 24 Invention Method |
| Installation Time | | 65 minutes | 37 minutes |
| Stability - under pressure of −0.036 inches water | Wall | Detached in 10 minutes | Still attached after 24 hours |
| | Floor | Detached in 3 minutes | Still attached after 24 hours |

Example 5

Water Infiltration Test

For Example 5, a containment enclosure was formed as described in Example 2 using with two layers of 0.006 inch adhesive coated sheet material except, that the floor was a concrete floor. A four-inch diameter circular piece of the two layers of the sheet covering the floor was removed, exposing the floor. Tap water was flooded onto the surface of the covered floor surface to a depth of about one inch, and left for about 10 hours. Then the water was removed and a one inch wide annulus of sheet was removed to enlarge the opening from 4 inches to 6 inches in diameter. The migration of water under the sheet was measured and found to have propagated ¼ inch. In comparison, it is noted that during pressure washing of the enclosure of Reference Example 1, water had migrated under cuts and tears in the poly flooring to soak the entire floor, requiring extensive cleaning after the barrier was removed.

The invention is not limited to the specific embodiments described above, but is defined by the claims and equivalents thereof.

What is claimed is:

1. A method for creating at least a partially enclosed space and controlled environment for abatement of physical material within a preexisting structure, the enclosed space being based at least in part on structural elements of the preexisting structure comprising:

attaching at least first and second barrier sheet lengths comprising separate lengths of flexible polymeric film in a sealed overlapping relationship to one another to a first surface of a first structural element of the preexisting space and attaching the overlapping barrier sheet lengths to a second surface of a second structural element of the preexisting space while at least partially covering an opening between the first and second surfaces for creating a barrier as part of an enclosure of a desired space with a controlled environment, said step of attaching at least the first and second barrier sheet lengths including using a holding system of each of the first and second barrier sheet lengths that extends over major surfaces thereof, wherein the holding system comprises an adhesive layer that substantially covers a major surface of each of the first and second barrier sheet lengths including an edge zone and an intermediate zone of the same major surface, so that the first barrier sheet length with the holding system is secured to the first surface of the first structural element at both the edge and intermediate zones and the second barrier sheet length with the holding system is adhesively sealed to an overlapping portion of the first barrier sheet length and the first surface of the first structural element.

2. The method of claim 1, wherein the holding system comprises pressure sensitive adhesive that is an acrylic adhesive.

3. The method of claim 1, wherein at least one barrier sheet length with pressure sensitive adhesive is adhered to more than one structural element of the preexisting structure.

4. The method of claim 1, wherein the barrier sheet lengths with pressure sensitive adhesive each comprise pressure sensitive adhesive provided in a substantially uniform manner over the major surface thereof, and the step of attaching that barrier sheet length to a structural element comprises adhering the barrier sheet length to the available surface of the structural component substantially uniformly.

5. The method of claim 1, wherein the first barrier sheet is adhered to at least a portion of a temporary structure of the preexisting structure.

6. The method of claim 1, wherein the first barrier sheet is adhered to at least a portion of a permanent structure of the preexisting structure.

7. The method of claim 1, wherein barrier sheet lengths are combined together and attached to the preexisting structure to create with the preexisting structure a substantially contained and enclosed space.

8. The method of claim 7, wherein at least a portion of one barrier sheet length covers an open area of the preexisting structure.

9. The method of claim 7, comprising steps within a method for removal of physical material from the enclosed space, wherein at least a portion of the preexisting structure with undesirable physical material is not covered with barrier sheet lengths so that physical material can be abated from the exposed preexisting structure.

10. The method of claim 9, further comprising the step of removing physical material from the preexisting structure.

11. The method of claim 10, further comprising the application of a negative pressure of 0.02 inches of water within the enclosed space during the removal step while utilizing the holding systems of the first and second barrier sheet lengths to maintain billowing from the first and second surfaces of the first and second structural elements to less than 2 inches.

12. The method of claim 1, comprising attaching a target material over at least a surface portion of a structural element and subsequently securing at least one of the first and second barrier sheet lengths to the target material by at least one portion of the holding system as provided extending over a major surface of a barrier sheet length.

13. The method of claim 12, wherein the target material includes a pressure sensitive adhesive for attaching to the surface of a structural element.

14. A method for the abatement of physical material from a preexisting structure comprising:

a. providing a structure having at least one working surface of a first structural element bearing a physical material to be removed, and at least one non-working surface of a second structural element, b. providing a plurality of barrier sheet lengths, each length of barrier sheet comprising a flexible polymeric film and that includes a holding system comprising an acrylic pressure sensitive adhesive layer that substantially covers a major surface thereof, the holding system with removable pressure sensitive adhesive provided to create an edge zone and an intermediate zone of the major surface as it is substantially covered by adhesive, c. securing the holding system of a first barrier sheet length by contacting the adhesive of the first barrier sheet length to the one non-working surface of the second structural element and a non-working surface of at least one other structural element that is spaced from the second structural element, so that a layer of the first barrier sheet length is secured to plural non-working surfaces to form an enclosure with the working surface of the first structural element to isolate a space to contain the physical material for subsequent removal, d. securing a second barrier sheet length along side and in a similar direction as the first barrier sheet length by contacting adhesive of the edge zone of the second barrier sheet length with an overlapping portion of the first barrier sheet length and adhesive of the intermediate zone of the second barrier sheet length to at least the one non-working surface of the second structural element, and then e. applying a negative pressure of 0.02 inches of water within the enclosed space while utilizing the holding systems of the first and second barrier sheet lengths to maintain billowing from the non-working surfaces of the structural elements to less than 2 inches.

15. The method of claim 14, wherein a plurality of additional barrier sheet lengths are attached to one another as well as to surfaces of at least one structural element for creating the barrier as part of the enclosure.

16. The method of claim 15 in which the removable pressure sensitive adhesive is a substantially continuous coating.

17. The method of claim 15 in which the non-working surface is at least one of a floor, a wall, or a ceiling.

18. The method of claim 17 in which the non-working surface is a plurality of walls.

19. The method of claim 17 in which the non-working surface is a ceiling and the ceiling is not covered.

20. The method of claim 18 in which the non-working surface is a floor.

21. The method of claim 20 in which the floor is covered with another length of barrier sheet that comprises one of an adhesive coated sheet and a sheet at least partially covered with a removable pressure sensitive adhesive.

22. The method of claim 15 in which the enclosure further includes a non-adhesive coated flexible plastic film.

23. An enclosure for isolating and containing physical materials comprising a structure having at least one working surface on a first structural element bearing a physical material to be removed, and a plurality of non-working surfaces on other structural elements to which is secured a plurality of lengths of flexible barrier sheet material with at least a first length of barrier sheet material lengthwise overlapping with a second length of barrier sheet material, wherein each of the first and second length of barrier material comprises a flexible polymeric film and includes a holding system comprising an acrylic pressure sensitive adhesive layer that substantially covers one of its major surfaces and creates an edge zone and an intermediate zone, such that the working surface of the first structural element and the plurality of lengths of barrier sheet material extending between plural non-working surfaces together form at least part of the enclosure having a plurality of adhesively sealed seams created by overlapping portions of adjacent lengths of barrier material and adhesive provided on edge zones thereof.

* * * * *